United States Patent [19]

Lindquist

[11] 4,278,042

[45] Jul. 14, 1981

[54] CAM CLEAT

[76] Inventor: Björn V. Lindquist, Nordhemsgatan 39, 413 06 Gothenburg, Sweden

[21] Appl. No.: 44,175

[22] Filed: May 31, 1979

[30] Foreign Application Priority Data

Jun. 12, 1978 [SE] Sweden ..... 7806785

[51] Int. Cl.[3] ..... B63B 21/04

[52] U.S. Cl. ..... 114/218; 24/134 KB; 188/65.2

[58] Field of Search ..... 114/108, 199, 218; 188/65.1, 65.2; 24/132 R, 132 WL, 136 R, 254, 255, 257, 134 KB

[56] References Cited

U.S. PATENT DOCUMENTS

| | | | |
|---|---|---|---|
| 940,512 | 11/1909 | Christensen | 114/199 |
| 2,547,370 | 4/1951 | Boyer | 24/134 KB |
| 3,677,214 | 7/1972 | Bernstein | 114/218 |
| 3,795,218 | 3/1974 | Merry | 114/218 |

*Primary Examiner*—Edward R. Kazenske

*Assistant Examiner*—Jesus D. Sotelo

*Attorney, Agent, or Firm*—Silverman, Cass & Singer, Ltd.

[57] ABSTRACT

A cam cleat designed to secure sheets, halyards, lines etc. introduced into it on boats. The cam cleat includes two parts moving respectively, towards and away from each other, the faces of these parts which face each other being serrated, and these parts being so designed that they adopt a fixed position and a free position and are so pivoted that when they rotate in the same direction they either move towards each other or away from each other. These parts are spring-loaded in such a way that the first of the parts strives to adopt the free position and the other of these parts strives to adopt the fixed position. Further, the first of these parts can be locked in the fixed position by an eccentric control device. The first part is pivoted about a point in such a way that when rotated from the fixed position to the free position its serrations tend to detension a line in the cam cleat.

4 Claims, 4 Drawing Figures

CAM CLEAT

BACKGROUND OF THE INVENTION

The invention described here is a cam cleat intended for locking sheets, halyards, other lines etc. primarily on boats and especially sailing boats.

Known cam cleats are mainly designed in accordance with one of the two principles explained below.

The cam cleat has generally one fixed and one moving part. In one design the moving part is pivoted near its end, this end being situated closest to the point of entry of the line. The intention is that the strain is taken on the line after which the moving part is pressed against the line, overcoming the force of a spring which otherwise pulls the moving part away from the line, the line is then released with the result that it is wedged fast by the serrated edge of the parts mentioned. Thus this cam cleat does not secure the line if an unexpected jerk occurs in the line while it is being pulled home and the line may be pulled out of the hands of the person pulling. It can be seen that this securing process requires a free hand. Furthermore, to release the line it is necessary to pull harder on the line than the actual load on the line in order that the moving part shall be released and return to its rest position under the action of the spring mentioned above.

In another design the moving part is pivoted as above but a spring presses the moving part against the fixed part. The cam cleat therefore secures the line if an unexpected jerk occurs as described. To release the line the moving part is controlled by means of a lever. Since the moving part is pivoted at the incoming end of the line, when the line is released the serrations of the moving part are forced along the line in such a way that the line is further tensioned until the opening between the parts mentioned is sufficient to allow the line pass. This sometimes makes it difficult to release the line when it is under great strain.

SUMMARY OF THE INVENTION

The invention described here concerns a cam cleat of which the disadvantages described above have been eliminated.

The invention relates to a cam cleat designed to secure sheets, halyards, other lines etc. introduced into it, primarily on boats, containing two parts which move towards one another to a fixing position and away from each other to a free position, the edges of these parts which face each other being serrated.

Features of the invention are that the first and the second of these two parts are pivoted in such a way that when they rotate in the same direction they move towards each other or away from each other, that the first part is sprung to adopt the free position while the second part is sprung to adopt the fixed position; that the first part is designed to be moved to and locked in the fixed position by means of a control device; and that the first part is pivoted about a point which, relative to its serrations, is so placed that when the first part is transferred from the fixed position to the free position its serrations, relative to a secured line under tension, are moved in the direction in which the line is tensioned.

BRIEF DESCRIPTION OF THE DRAWINGS

The invention is described in more detail below in association with the enclosed drawings in which.

DESCRIPTION OF THE PREFERRED EMBODIMENT

Figure 1:
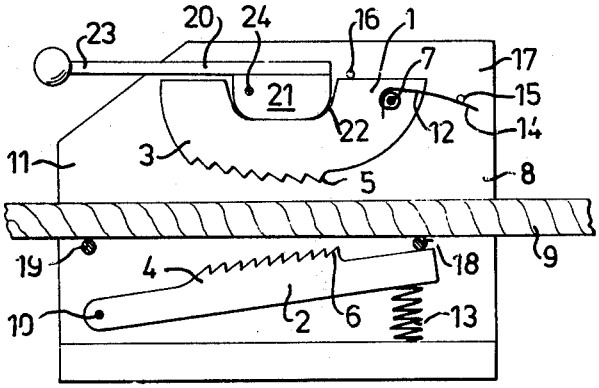
FIG. 1 shows the cam cleat with the right-hand plate of FIG. 2 removed, in a free position.
Figure 2:
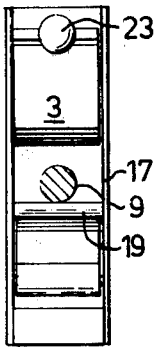
FIG. 2 shows a cam cleat seen from the side on which the line enters, corresponding to from the left in FIG. 1.
Figure 3:
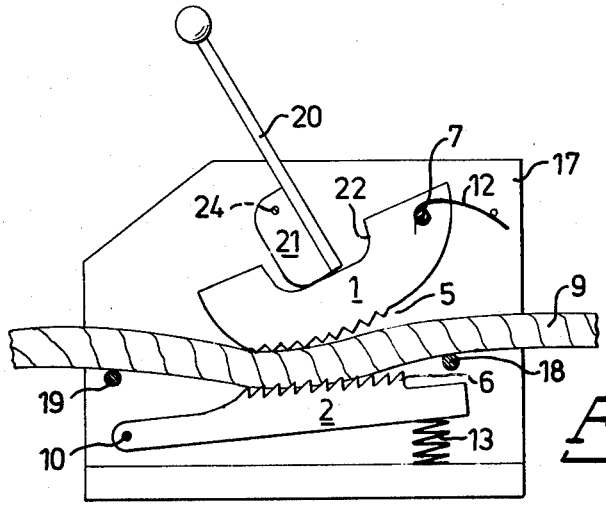
FIG. 3 shows the cam cleat of FIG. 1 in the fixed position.

FIGS. 1, 2 and 3 show a cam cleat comprising two parts which move towards and away from each other, respectively the first part 1 and the second part 2. The facing edges 3,4 of parts 1, 2 are provided with serrations 5,6. Parts 1 and 2 are designed to be able to adopt a fixed position and a free position.

The first part 1 is pivoted so as to rotate around an axle 7 at a point which, relative to its serrated surface 3, can be moved towards the side 8 of the cam cleat on which it is intended that a line 9 shall not be under load. The second part 2 is pivoted so as to rotate around an axle 10 at a point which, relative to its serrated surface 4, has been moved towards the other side 11 of the cam cleat Parts 1 and 2 are thus so pivoted that when rotated about their respective pivots in the same direction, in FIG. 1 counterclockwise, they approach each other.

The first part 1 and the second part 2 are spring-loaded by means of a torsion spring 12 and a pressure spring 13 respectively in such a way that the first part strives to adopt the free position shown in FIG. 1 and the second part strives to adopt the fixed position shown in FIG. 1. One end 14 of the torsion spring presses, for example, against pin 15 or the like. A pin 16 or an enclosing housing or the like limits the clockwise rotation of the first part 1. A rod 18 or the like limits the counterclockwise rotation of the second part 2. This rod 18, and in the same way another rod 19 at the other side 11 of the cam cleat, can suitably be designed to serve as sliding surfaces when the line 9 runs free out from the cam cleat. The straight line between the rods 18 and 19 shall then lie above the serrations 6 of the second part 2 while the second part 2 is in the fixing position.

By means of an eccentrically pivoted control device 20, the first part 1 can be moved to and locked in the fixed position as shown in FIG. 3. The control device 20 comprises a body 21 which is essentially rectangular or semi-elliptic in cross-section, designed to function in conjunction with a recess 22 in the first part 1. This body is eccentrically pivoted on an axle 24. Attached to the body 22 is a control arm 23. The body 21 is in the main wholly positioned in the above-mentioned recess 22 when the first part 1 is moved away from the second part 2, i.e. when the first part 1 is in the free position, see FIG. 1. The body 21 is turned or rotated about 90° in relation to the position just described when the first part 1 is moved towards the second part 2, i.e. when the first part 1 is in the fixed position, see FIG. 3.

Furthermore, the body 21 is so designed that its shape in conjunction with the shape of the recess 22 provides self-locking in relation to the the recess when the first part 1 is in the fixed position.

In use, a line 9 is fed through the cam cleat from left to right in FIG. 1 with the first part 1 in the free position. The first part 1 is then moved to the fixed position as shown in FIG. 3, after which the line is pulled home to the right in FIG. 3, the line running easily since the second part 2 is sprung. If so desired, the line may naturally be pulled home to a large extent without the first part 1 being in the fixed position. When the line has been pulled home to the desired extent it is prevented from moving to the left in FIG. 3 by the serrations 5 and 6 which are directed to the right, thus gripping into the line.

When the line is to be released, the control device 20 is moved to the position shown in FIG. 1, whereupon the first part 1 is turned to the free position under the influence of spring 12.

Because of the pivoting system described, the serrations 5 of the first part 1 strive to tension the line 9 when this part is moved from the free position to the fixed position by means of the control arm 20. In a corresponding manner the line 9 is thus detensioned when the first part, after turning the control device 20, under the influence of spring 12 is moved to the free position. As a result it is very easy to release a line secured by this cam cleat.

Figure 4:
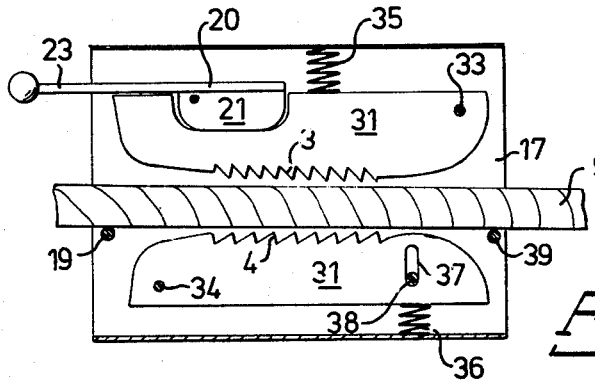
FIG. 4 shows a modified design of the cam cleat according to the invention in its free position.

FIG. 4 shows a modified design of the invention.

In the design shown in FIGS. 1 and 2, the first part 1 is essentially semi-circular in shape and the second part 2 bar-shaped.

In the design shown in FIG. 4, in which the corresponding parts have been given the same number symbols as in FIG. 1, the first part 31 and the second part 32 have essentially the same shape. In this case, parts 31 and 32 are designed so that their cross-sections have an elongated semi-elliptical shape. The pivoting of these parts, about axles 33 and 34, corresponds to that shown for the previous design. The first part 31 is spring-loaded by means of a spiral tension spring 35 and the second part 32 is spring-loaded by means of a spiral compression spring 36.

In this second design, the counterclockwise movement of the second part 32 is limited by a slot 37; a securable pin 38 traveling along this slot. The pin 38 is attached to one side of the housing 17. There is a rod 39 corresponding to rod 19 at the point of exit of the line from the cam cleat.

The function of the cam cleat in this second design is the same as in the first design. One of the advantages of the second design is the adjustability of the counterclockwise movement of the second part 32 for use with lines of different diameters. In accordance with the first design, the difference in diameter is controlled by the spring-loaded of the second part 2.

The cam cleat including the housing 17 could suitably be made of aluminum or stainless steel.

The cam cleat according to this invention has several considerable advantages. When the first part is in the fixed position the cam cleat secures the line while it is being pulled home, with the result that the pulling home can be interrupted at any time and that the cam cleat secures the line if unexpected jerks occur. Since the serrations of the first part detension the line when it is moved to the free position, it is always easy to release the line and the wear on the line is very slight. Furthermore, this cam cleat can be manufactured easily and cheaply and it is easy to control.

The design of parts 1 and 2 and the control device 20 can of course be considerably modified without abandoning the philosophy of the invention, namely that both these parts are pivoted in such a way that when they rotate in the same direction about their respective pivots they approach each other or move away from each other and are so pivoted that the serrations of the first part tend to detension the line in the cam cleat when the first part is moved from the fixed position to the free position.

Thus, the invention can be varied within the framework of the enclosed patent claims and it must not be considered to be limited to the designs specified above.

I claim:

1. A cam cleat for securing a line which is tensioned in one direction comprising:

a housing;

a first part attached to the housing by an axle;

a second part attached to the housing by an axle with the line being receivable between the first and second parts;

the first and second parts being pivotable around their respective axles toward one another to a fixed position and away from one another to a free position, the first and second parts having serrated surfaces facing one another;

the first and second parts when pivoted around their respective axles in one direction approaching one another and in the other direction moving away from one another;

one spring coupled to the first part and the housing so that the first part is spring-loaded to adopt the free position;

another spring coupled to the second part and the housing so that the second part is spring-loaded to adopt the fixed position;

control means for moving the first part to and locking the first part in the fixed position when operated;

the axle of the first part and the serrated surface of the first part being positioned so that when the first part is moved from the free position to the fixed position, the serrations move in the one direction in which the line is tensioned.

2. The cam cleat as claimed in claim 1 in which the first part is pivoted around its axle towards a side of the housing at which the line is detensioned and the second part is pivoted around its axle towards the opposite side of the housing.

3. The cam cleat as claimed in claims 1 or 2 in which the control means include a body with a basically rectangular shape which is eccentrically pivoted on the housing, the first part having a recess of the same shape as the body, the body cooperating with the first part such that the body is placed in the recess when the first part is displaced from the second part and the body is rotated relative to the recess when the first part is displaced towards the second part.

4. The cam cleat as claimed in claim 3 in which the body and the recess have shapes so that the body self-locks in the recess when the first part is displaced towards the second part.

* * * * *